US009307591B2

(12) United States Patent
Haensgen et al.

(10) Patent No.: US 9,307,591 B2
(45) Date of Patent: Apr. 5, 2016

(54) SYSTEMS, METHODS, AND DEVICES FOR PROVIDING A LUMINAIRE INDUCTIVELY COUPLED TO A POWER TRANSMISSION LINE

(71) Applicants: Gregg James Haensgen, Menomonee Falls, WI (US); John Fredrick Banting, Waukesha, WI (US)

(72) Inventors: Gregg James Haensgen, Menomonee Falls, WI (US); John Fredrick Banting, Waukesha, WI (US)

(73) Assignee: COOPER INDUSTRIES HOLDINGS (IRELAND), Dublin (IE)

( * ) Notice: Subject to any disclaimer, the term of this patent is extended or adjusted under 35 U.S.C. 154(b) by 66 days.

(21) Appl. No.: 14/215,729

(22) Filed: Mar. 17, 2014

(65) Prior Publication Data

US 2014/0268701 A1 Sep. 18, 2014

Related U.S. Application Data

(60) Provisional application No. 61/798,044, filed on Mar. 15, 2013.

(51) Int. Cl.

| | |
|---|---|
| ***H01F 27/42*** | (2006.01) |
| ***H05B 33/08*** | (2006.01) |
| ***F21V 23/02*** | (2006.01) |
| *F21S 8/08* | (2006.01) |
| *F21W 131/103* | (2006.01) |

(52) U.S. Cl.

CPC ..... *H05B 33/0815* (2013.01); *F21V 23/02* (2013.01); *F21S 8/085* (2013.01); *F21W 2131/103* (2013.01)

(58) Field of Classification Search

CPC ..... F21L 4/08; F21S 8/085; F21S 8/086; Y02B 20/72; F21V 23/001; F21V 23/002; H05B 33/00; H05B 33/0815

See application file for complete search history.

(56) References Cited

U.S. PATENT DOCUMENTS

| | | | | |
|---|---|---|---|---|
| 5,448,138 | A * | 9/1995 | Staggs | 315/248 |
| 6,027,225 | A | 2/2000 | Martin et al. | |
| 8,878,395 | B2 * | 11/2014 | Aiello et al. | 307/104 |
| 2002/0008973 | A1 | 1/2002 | Boys | |
| 2003/0132720 | A1 | 7/2003 | El Bitar | |

(Continued)

FOREIGN PATENT DOCUMENTS

| | | |
|---|---|---|
| EP | 2385747 | 11/2011 |
| WO | WO 2005/031944 | 4/2005 |
| WO | WO 2006/046264 | 5/2006 |

OTHER PUBLICATIONS

International Search Report for PCT/IB2014/000970, mailed Oct. 17, 2014.

*Primary Examiner* — Daniel Cavallari

(74) *Attorney, Agent, or Firm* — King & Spalding LLP

(57) ABSTRACT

Systems, methods, and devices for providing a luminaire inductively coupled to a power transmission line include a current transformer containing a plurality of tap points, and a plurality of tap switches that can be coupled to the tap points. The plurality of tap switches are connected to a microcontroller. Further, the systems, methods, and devices include an energy storage device, and LED light source(s). In some instances the current transformer powers the LED light source(s), and in other instances, the current transformer charges the energy storage device and the energy storage device in turn powers the LED light source(s), and in yet other instances, a combination of powering directly from the current transformer or energy storage device may be switched back and forth depending on a variety of parameters.

15 Claims, 4 Drawing Sheets

(56) References Cited

U.S. PATENT DOCUMENTS

| | | | | |
|---|---|---|---|---|
| 2007/0120421 | A1 | 5/2007 | Boys | |
| 2009/0222223 | A1* | 9/2009 | Walters et al. | 702/58 |
| 2009/0230777 | A1 | 9/2009 | Baarman | |
| 2009/0303703 | A1* | 12/2009 | Kao et al. | 362/183 |
| 2010/0072753 | A1 | 3/2010 | Bell | |
| 2010/0084820 | A1 | 4/2010 | Maeda et al. | |
| 2011/0291488 | A1 | 12/2011 | Paik et al. | |
| 2011/0309760 | A1* | 12/2011 | Beland et al. | 315/201 |
| 2012/0080944 | A1 | 4/2012 | Recker et al. | |
| 2012/0146536 | A1* | 6/2012 | Mullen et al. | 315/251 |
| 2012/0256490 | A1 | 10/2012 | Zheng | |

* cited by examiner

SYSTEMS, METHODS, AND DEVICES FOR PROVIDING A LUMINAIRE INDUCTIVELY COUPLED TO A POWER TRANSMISSION LINE

CROSS REFERENCE TO RELATED APPLICATIONS

This application claims priority to U.S. Provisional Application No. 61/798,044, filed Mar. 15, 2013, and titled "Systems, Methods, Devices for Providing a Luminaire Inductively Coupled to a Power Transmission Line," the entire content of which is hereby incorporated herein by reference.

FIELD OF THE INVENTION

Embodiments of this disclosure relate generally to lighting solutions, and more particularly to systems, methods, and devices for providing a luminaire that is inductively coupled to a power transmission line.

BACKGROUND OF THE INVENTION

In association with outdoor lighting, there have been previous attempts to power street lights and/or other outdoor or indoor luminaires through harvesting wind or solar power to charge a battery source that in turn powers a light source of a luminaire. However, wind and solar power sources are not always available, leaving an outdoor luminaire powered by such sources dependent on weather conditions. Moreover, the battery or energy storage devices required to operate such luminaires have a limited life span. Additionally, the potentially sporadic nature of the charging cycles associated with available wind or solar energy make the charging of the energy storage device more difficult. Furthermore, such wind or solar collection hardware devices and energy storage devices are costly to install, require generally large hardware, and typically require a pole nearby for the installation.

In other outdoor lighting solutions, there have been attempts to power street lights directly from the 120/240V secondary of a transformer. However, this type of solution involves additional costs of transformer hardware, such as transformer protection devices (e.g., fuses and lightning arresters), as well as higher costs on ballasts, dimming controls, and more costly installation than current street lights. Additionally, transformers are not always located where light is needed. To power such a street light, it is required to have secondary voltage in the vicinity of where the street light is needed. This sometimes requires running long cables to a transformer or adding another transformer at the location the light is needed, which adds to costs. Accordingly, there is a need for a solution that addresses one or more of the above-mentioned shortcomings associated with energy solutions for general lighting.

SUMMARY

The present disclosure can address the needs described above with a system, method, and device for providing a luminaire inductively coupled to a power transmission line.

In one aspect, an outdoor luminaire includes a housing that is electrically and mechanically coupled to a power transmission line. Further, the outdoor luminaire includes at least one light source that is coupled to the housing. The power transmission line and the at least one light source are inductively coupled.

In another aspect, an outdoor luminaire includes at least one LED light source that is coupled to a housing. The housing is mechanically coupled to a power transmission line. In addition to the at least one LED light source, the outdoor luminaire includes an energy storage device located on or in the housing. The energy storage device is electrically coupled to the at least one LED light source, and the power transmission line and the energy storage device are inductively coupled.

In yet another aspect, a luminaire includes a current transformer that comprises a plurality of tap points. Further, the luminaire includes a plurality of tap switches that are adapted to be coupled to the plurality of tap points. The plurality of tap switches is coupled to a microcontroller. In addition to the current transformer and the plurality of tap switches, the luminaire includes at least one LED light source.

These and other aspects, features, and embodiments of the disclosure will become apparent to a person of ordinary skill in the art upon consideration of the following brief description of the figures and detailed description of illustrated embodiments.

BRIEF DESCRIPTION OF THE FIGURES

Figure 1:
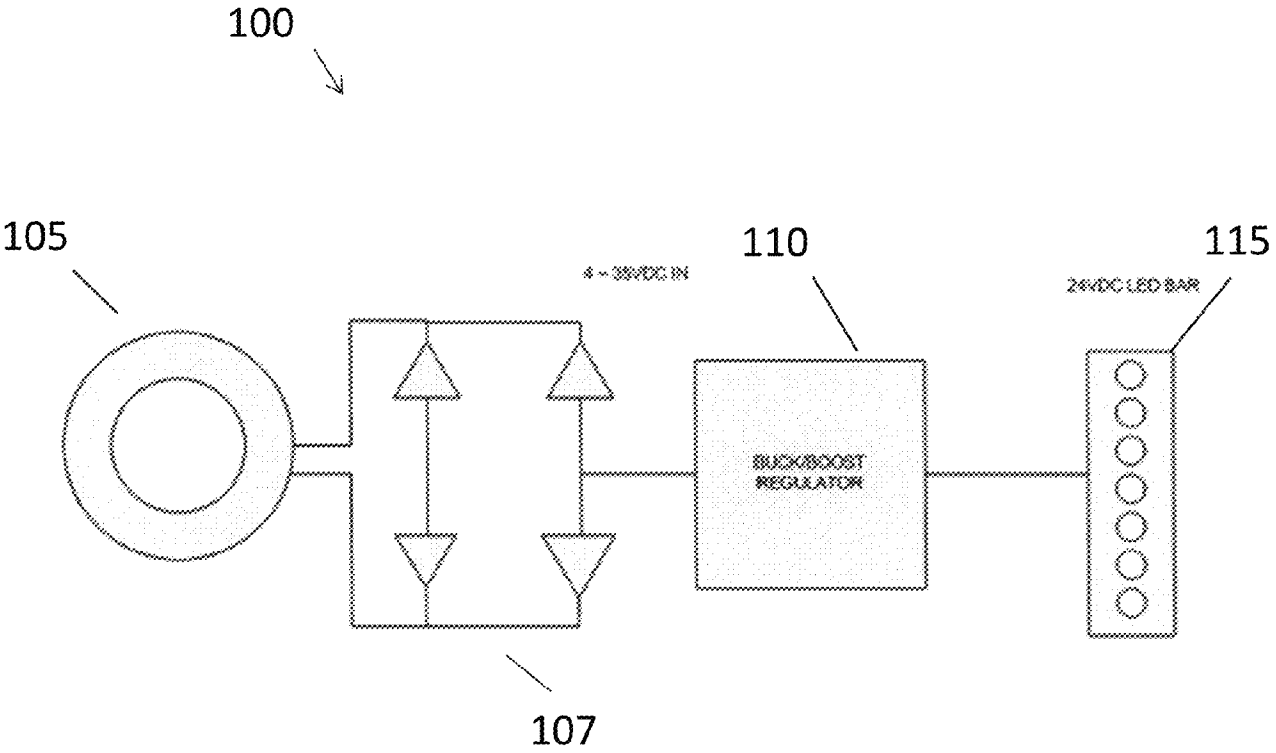

Having thus described the invention in general terms, reference will now be made to the accompanying drawings, which are not necessarily drawn to scale, and wherein:

FIG. 1 is a block diagram showing an inductive coupling system for an outdoor luminaire where the inductively coupled luminaire is powered directly from the electromagnetic field of a power transmission line with no energy storage device in accordance with certain example embodiments.

Figure 2:
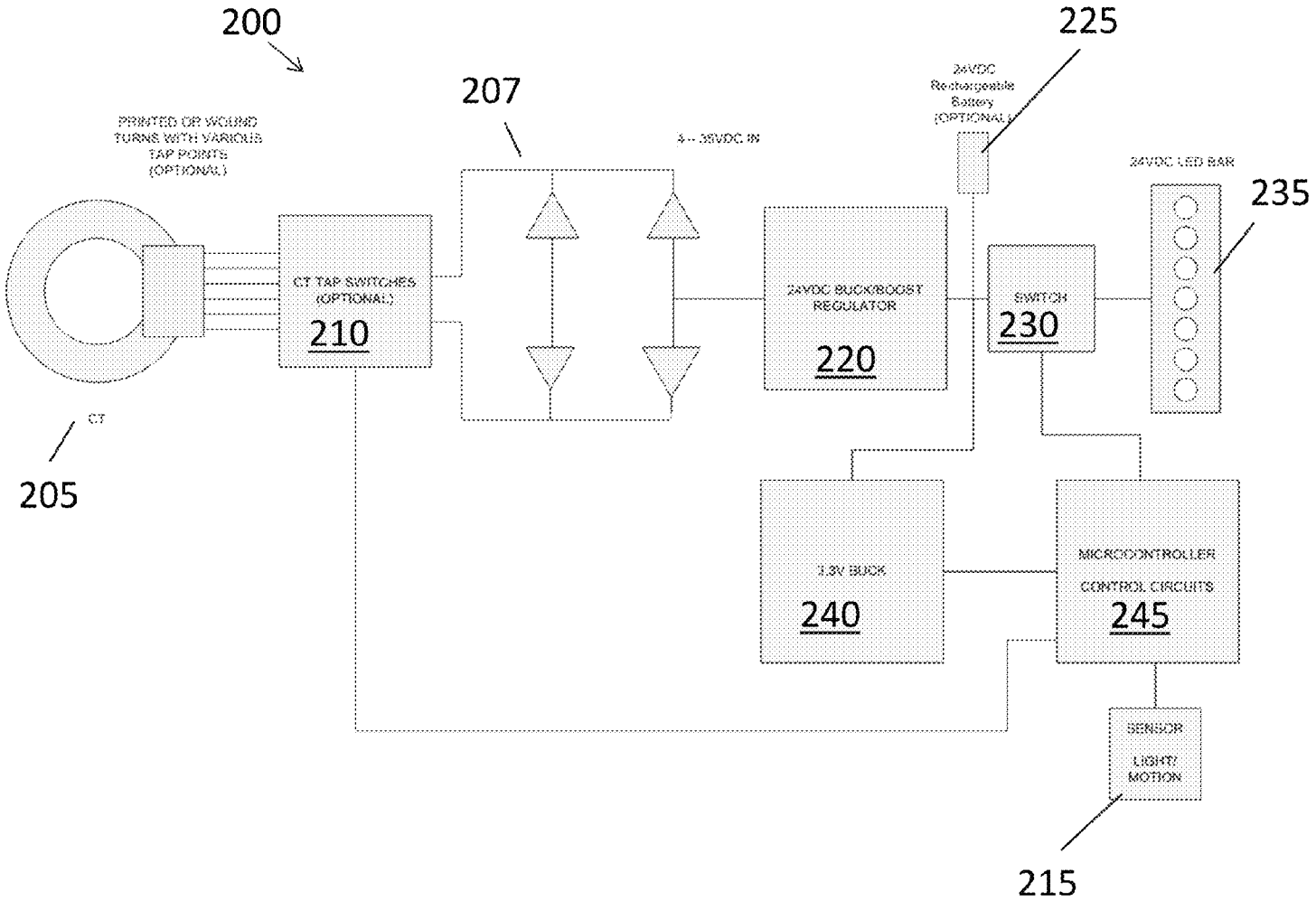

FIG. 2 is a block diagram showing an inductive coupling system for an outdoor luminaire where the inductively coupled luminaire powers an energy storage device that in turn powers the light source of the luminaire in accordance with certain example embodiments.

Figure 3:
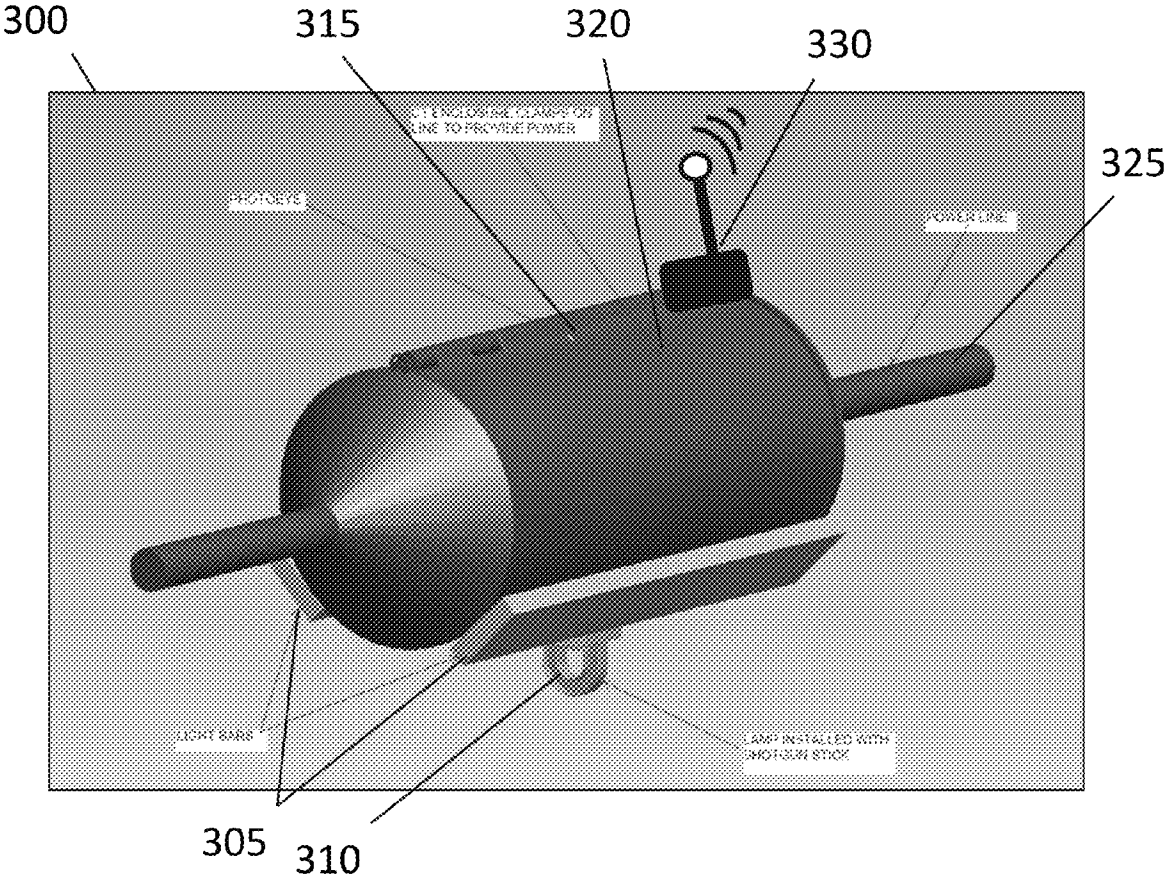

FIG. 3 illustrates a current transformer enabled outdoor luminaire hanging directly onto the power transmission line and is attached via a "hot-stick" or a gloved-on method in accordance with certain example embodiments.

Figure 4:
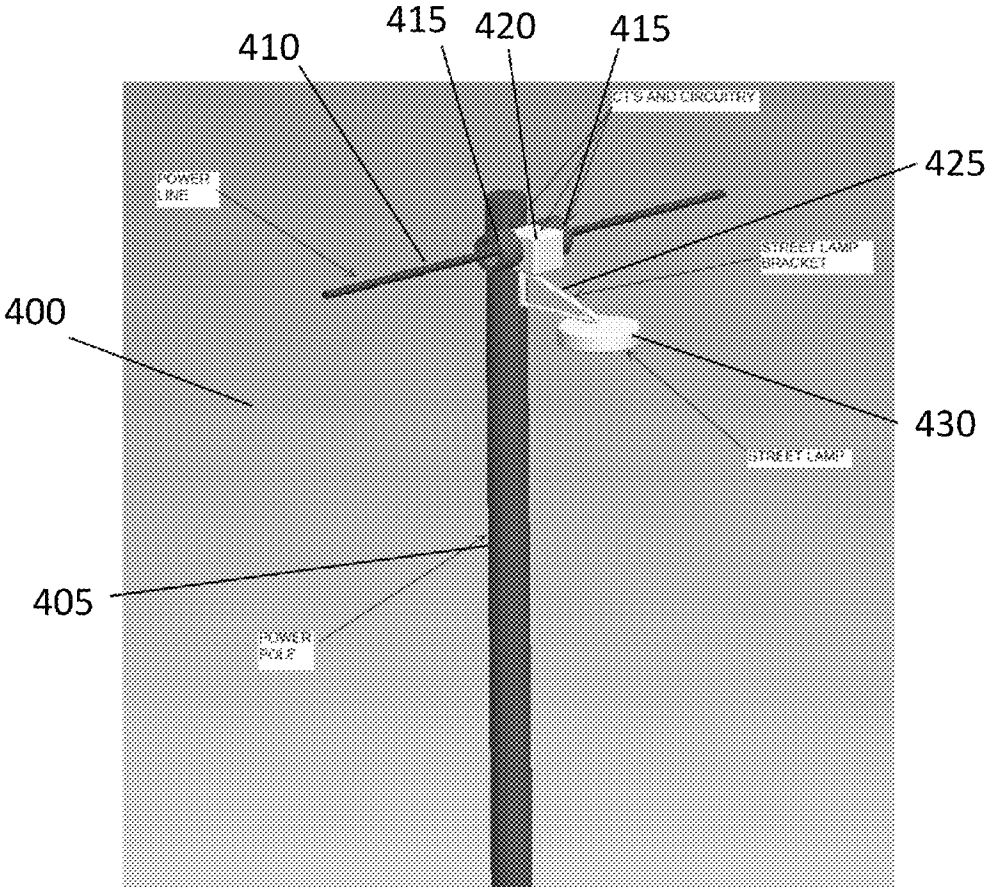

FIG. 4 illustrates a current transformer enabled outdoor luminaire that is installed on a pole in accordance with certain example embodiments.

DETAILED DESCRIPTION OF EXAMPLE EMBODIMENTS

Embodiments of this disclosure are directed to powering luminaires via power transmission line harvesting technology. The systems and methods described herein may provide several advantages including the ability to power a street light from a power transmission line with a current transformer by coupling alternating current (AC) from high voltage primary or lower voltage secondary conductors to a light emitting diode (LED) based luminaire. Lighting a LED based luminaire by powering the LED based luminaire from a power transmission line with a current transformer enables a reduction in certain costs associated with ballast, heat sinks, transformers, fusing, protection devices and dimming controls that are commonly used with outdoor LED based luminaires. Another significant advantage of this design is the relative cost of the solution. A traditional power transformer is quite costly due in part to installation costs as well as the protective devices involved. These costs can be an order of magnitude higher than the proposed solution.

Embodiments of this disclosure now will be described more fully hereinafter with reference to the accompanying drawings, in which embodiments of the disclosure are shown. This disclosure may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

FIG. 1 is a block diagram showing an inductive coupling system 100 for an outdoor luminaire where the inductively coupled luminaire is powered directly by an electromagnetic field of a power transmission line in accordance with certain example embodiments. As shown in the example embodiment of FIG. 1, a current transformer 105 obtains power from a power transmission line without having a battery backup or energy storage device. In alternate embodiments, an energy storage device may be implemented with the system. In an example embodiment, the current transformer may be a nanocrystalline current transformer, i.e., the current transformer may have a nanocyrstalline core. The output of the current transformer may be an alternating current (AC) which has to be converted to a direct current (DC) for operation of a light source 115. Accordingly, the output of the current transformed 105 is fed to an AC to DC converter such as rectifier 107. The rectifier 107 converts the AC to a DC and outputs DC to a buck or boost regulator 110 as shown in FIG. 1. The buck or boost regulator 110 regulates the lower or higher voltages from the current transformer 105 to a desired voltage necessary to power a light source 115, such as 24 VDC LED-based light bars.

FIG. 2 is a block diagram showing an inductive coupling system 200 for an outdoor luminaire where the inductively coupled luminaire may charge an energy storage device 225 that in turn powers the light source 235 of the luminaire in accordance with certain example embodiments. As shown in FIG. 2, the inductive coupling system 200 balances the voltage and current produced by the current transformer 205. In an example embodiment, the physical size of the current transformer 205 will determine the amount of energy harvested. Moreover, the number of secondary turns will determine the amount of current available for powering the light source 235 (e.g., LED based light modules/bars used in outdoor luminaires such as street lights). For instance, a larger number of turns correlates to a higher output voltage but lower available current. Conversely, a smaller number of turns correlates to a higher available current, but the voltage available is lower. Therefore, according to the example embodiment of FIG. 2, a multi-tap current transformer design is used that can adjust and optimize the tap point to get the desired current and voltage performance "on the fly."

A multi-tap current transformer winding design can balance the current supplied to the buck/boost regulator 220. In operation, when the line currents are low, a switch to a lower turn tap point can be made via current transformer tap switches 210 controlled by a microcontroller 245 to supply higher current at a lower voltage that is high enough to boost to a voltage level required to power the light source 235 (e.g., 24 VDC light bars). When the line currents are high, the current transformer tap switches 210 can tap to a higher turn tap point in order to lower the current but still obtain the voltage necessary for the buck or boost regulator 220 to achieve the voltage to illuminate the light source 235. Similar to the example embodiment in FIG. 1, a rectifier 207 can convert the AC from the current transformer 205 to DC for delivery to the buck or boost regulator 220. The turns of the current transformer 205 may be printed on a multi-layer PCB, wound around the current transformer, or wound around a bobbin and placed over the current transformer with several available tap points.

As shown in the example embodiment of FIG. 2, the microcontroller 245 may also control a switch 230 to engage or disengage the light source 235. Further, the microcontroller 245 can monitor a sensor or sensors 215 for detecting light or motion to determine when to engage or disengage the light source 235. In addition, the microcontroller 245 can determine when to switch between the current transformer and rechargeable battery 225. Each of the above-mentioned capabilities and more may be made operational based on certain logic that is preprogrammed in the microcontroller 245.

In one embodiment of the disclosure, an energy storage device 225 (e.g. a 24 VDC battery) may be present to directly power the light source 235 (e.g., LED light bars) via the buck circuitry 240. This would provide a steady means of powering the LED-based light source 235. In an example embodiment, the energy storage device may be charged based on power from the transmission line. In another example embodiment, the energy storage device can be charged based on both power from the power transmission line and/or energy harvested from other sources such as vibration, solar, temperature, RF, and so on.

In some example embodiments, the current transformer may charge an energy storage device when the light source is not in use (e.g., when the microcontroller 245 uses a photosensor 215 to determine that there is sufficient daylight to not warrant engaging the light source 235 via the switch 230), such that when the light source is needed it can be powered through the energy storage device only, or alternatively may be switched between being powered by the energy storage device 225 and the current transformer 205 as determined by the microcontroller 245.

The size and recharge rate of the energy storage device 225 or the efficiency of the current transformer 205 necessary to power the light source(s) 235 may be assisted through the use of motion sensor(s) and/or dimming controls (e.g., the current limiting dimming capabilities discuss below.) That is, when motion is detected in the vicinity of the outdoor luminaire via the motion sensor associated with that luminaire, the microcontroller 245 may engage, dim, or intensify the light source 235. For example, when no motion is detected within a visible radius of the motion sensor, the microcontroller may decide to dim the LED lights, which in turn results in efficient usage of either the current transformer or the energy storage device.

In one embodiment, the multi-tap current transformer winding design may be used to dim the light source(s) by current limiting the LED light sources. In other words, it is possible to dim the LED lights by changing the tap points instead of the (often expensive) conventional dimming controls used in existing outdoor luminaires. In some example embodiments, discrete circuit components may implement the logic controlled by the microcontroller described above. Other example embodiments may use an asynchronous integrated circuit (ASIC) chip designed to execute the logic associated with the microcontroller in the description above to control the current transformer taps, switches, sensors, and/or light source.

FIG. 3 is a current transformer enabled outdoor luminaire 300 hanging directly onto the power transmission line 325 and is attached via a "hot-stick" or a gloved-on method in accordance with an example embodiment of the invention. As shown in the example embodiment of FIG. 3, the outdoor luminaire 300 includes a current transformer enclosure 320 that clamps onto (or surrounds) the power transmission line 325 to inductively couple the outdoor luminaire 300 to the power transmission line 325. Also shown in the example embodiment of FIG. 3 are LED based light sources (or light bars) 305 that are powered via the current transformer, and a connector 310 used as part of the clamping process for clamping the outdoor luminaire 300 to the power transmission line 325. Through the use of the connector 310 in conjunction with a long pole, the luminaire 300 may be attached with a hot stick or shotgun stick directly on the power transmission line 325.

Also shown in the example embodiment of FIG. 3 is a sensor 315, such as a photosensor for detecting day light. In one example application, the sensor 315 may be used to determine when the light sources 305 should be illuminated, and when the ambient conditions indicated by the sensor 315 would determine the need for additional light. In some embodiments of the invention, when the sensor 305 determines that the light sources 305 do not need to be illuminated, the power harvested by the current transformer coupling to the power transmission line may be used to charge an energy storage device integrated with or connected to the luminaire 300 to allow the light sources 305 to be powered by the energy storage device at a later time (i.e., when the sensor 315 indicates the need for the light source 305 to be illuminated). In other embodiments of the invention other sensors may be integrated with or used in conjunction with the luminaire 300, such as a motion sensor used to dim lights when no traffic is present under or near the luminaire 300 and increase the intensity when cars or pedestrians are detected under or near the luminaire 300.

As shown in the example embodiment of FIG. 3, the luminaire may include a communications module 330, such as a radio frequency transmitter (or transceiver), indicator light, siren or other communication means. The communications module 330 can be powered from the inductive coupling of the current transformer to the power transmission line to relay information, such as an operating status (e.g., on, off, a periodically repeating signal that the system or luminaire is operating properly, or other similar status or data communication) or parameter of the luminaire (e.g., power efficiency, power consumption, light level, etc.,) to a remote device (such as a gateway, central monitoring location, a mobile device, etc.). Such a communication module 330 may allow for rapid response to defective systems or light sources, power outages, tampering, destruction, etc., by sending an RF based message or causing a change in an external indicator light status (blinking, color change, etc.), or engage a siren to produce an audible sound (beeping, alarm, etc.), or some other communication means to relay status information associated with the luminaire, sensor(s), or power transmission line. The communication module 330 may have its own dedicated processor or may be controlled by a processor (e.g., microcontroller, ASIC, etc.) controlling the light source and/or sensor(s) of the luminaire.

In another example embodiment, the communication module 330 described above with reference to FIG. 3 may be powered from the energy storage device that is in turn charged through the inductive coupling of the current transformer and power transmission line. In such a configuration, when a power outage occurs on the power transmission line, the energy storage device may still provide power to the microcontroller and communication module 330 to transmit information (distress signal with luminaire identification information, or turn on an external indicator light, or engage an audible alarm, etc.) regarding the power outage and/or continue to power the light source at full or partial light levels to provide emergency lighting to the area around the luminaire impacted by the power outage.

FIG. 4 is a current transformer enabled outdoor luminaire 400 that is installed on a pole 405 in accordance with an example embodiment of the invention. As shown in the example embodiment of FIG. 4, the current transformer inductive coupling components 415 and 420 may be inductively coupled to the power transmission line 410 and harvest power from the power transmission line 410 in a manner similar to that described in connection with the previous example embodiments of this disclosure. The outdoor luminaire 430 (e.g., LED based street light) is connected to the pole 405 by a mounting bracket 425 or other mounting means. The luminaire 430 receives power from the current transformer inductive coupling components 415 and 420. Similar to the example embodiment of FIG. 3, the example embodiment of FIG. 4 may also include a communication module powered through the current transformer or through an energy storage device and provide similar functionality as that which is described above with reference to FIG. 3.

Although not shown in the referenced figures, there are other applications of this power transmission line harvesting technology contemplated that can be used for powering of other devices either separately or in conjunction with LED street lights. These devices include but not limited to warning lights, cameras, radios, and monitoring equipment.

Accordingly, many modifications and other embodiments of the disclosure set forth herein will come to mind to one skilled in the art to which these disclosure pertains having the benefit of the teachings presented in the foregoing descriptions and the associated drawings. Therefore, it is to be understood that the disclosure is not to be limited to the specific embodiments disclosed and that modifications and other embodiments are intended to be included within the scope of this application. Although specific terms are employed herein, they are used in a generic and descriptive sense only and not for purposes of limitation.

What is claimed is:

1. An outdoor luminaire comprising:
a housing that is mechanically coupled to a power transmission line;
at least one light source coupled to the housing;
a current transformer to inductively couple the at least one light source to the power transmission line and comprising at least one tap point; and
at least one tap switch coupled to the at least one tap point and controlled by a microcontroller,
wherein the at least one light source is dimmed based at least in part on a selective engagement of the at least one tap switch by the microcontroller.

2. The outdoor luminaire of claim 1, wherein the housing houses the current transformer containing the at least one tap point.

3. The outdoor luminaire of claim 1, wherein the at least one light source comprises an LED light source.

4. The outdoor luminaire of claim 1, wherein the housing is mechanically coupled to the power transmission line by being clamped around the power transmission line.

5. The outdoor luminaire of claim 1, further comprising:
an energy storage device,
wherein the current transformer charges the energy storage device and the energy storage device powers the at least one light source; and
a photosensor connected to the microcontroller,
wherein the photosensor provides an indication to the microcontroller for when the energy storage device is to be engaged to power the light source.

6. An outdoor luminaire, comprising:

a housing that is configured to mechanically couple to a power transmission line;

at least one light source coupled to the housing, wherein the at least one light source is powered by a current transformer, wherein the current transformer is configured to inductively couple to the power transmission line; and a communication module powered by the current transformer, wherein the communication module is configured to wirelessly broadcast status data associated with one or more operating parameters of the outdoor luminaire.

7. An outdoor luminaire, comprising:

a housing that is configured to mechanically couple to a power transmission line;

at least one light source coupled to the housing a current transformer configured to inductively couple the at least one light source to the power transmission line;

an energy storage device, wherein the current transformer charges the energy storage device and the energy storage device powers the at least one light source; and at least one of a photosensor and a motion sensor connected to a microcontroller, wherein the at least one of the photosensor and the motion sensor are configured to provide an indication to the microcontroller for when to engage the energy storage device to power the light source.

8. A luminaire comprising:

a current transformer containing a plurality of tap points;

a plurality of tap switches that are adapted to be coupled to the plurality of tap points, wherein the plurality of tap switches are coupled to a microcontroller; and at least one LED light source.

9. The luminaire of claim 8, further comprising an energy storage device, wherein the current transformer charges the energy storage device and the energy storage device powers the at least one LED light source.

10. The luminaire of claim 9, further comprising: a photosensor connected to the microcontroller, wherein the photosensor provides an indication to the microcontroller for when to engage the energy storage device to power the LED light source.

11. The luminaire of claim 9, further comprising: a motion sensor connected to the microcontroller, wherein the motion sensor provides an indication to the microcontroller for when to engage the energy storage device to power the LED light source.

12. The luminaire of claim 8, wherein the current transformer is inductively coupled to a power transmission line.

13. The luminaire of claim 8, wherein the luminaire is clamped to a power transmission line.

14. The luminaire of claim 8, wherein the at least one LED light source is dimmable based at least in part on selective engagement of one or more of the plurality of tap switches by the microcontroller.

15. The luminaire of claim 8, wherein the current transformer and the at least one LED light source are located each in separate housings.

* * * * *